US005161257A

United States Patent [19]

Arensdorf et al.

[11] Patent Number: 5,161,257

[45] Date of Patent: Nov. 10, 1992

[54] FOOTBALL GRIDLE

[75] Inventors: Stephen C. Arensdorf; Lawrence T. Stromgren, both of Hays, Kans.

[73] Assignee: Stromgren Supports, Inc., Hays, Kans.

[21] Appl. No.: 850,523

[22] Filed: Mar. 13, 1992

[51] Int. Cl.[5] ..... A41D 13/00; A41C 1/00

[52] U.S. Cl. ..... 2/2; 2/22; 2/23; 2/79; 2/227; 2/247; 2/243 R

[58] Field of Search ..... 2/1, 2, 22, 23, 84, 2/67, 78 A, 78 B, 78 C, 78 D, 79, 227, 228, 247, 248, 249, 250, 243 R, 243 B; 450/98, 115, 116, 117

[56] References Cited

U.S. PATENT DOCUMENTS

| | | | |
|---|---|---|---|
| 891,977 | 6/1908 | Bloch | 2/247 X |
| 1,573,212 | 2/1926 | Whitley et al. | 2/23 |
| 1,602,454 | 10/1926 | Riddell | 2/23 |
| 1,915,754 | 6/1933 | O'Shea | 2/2 |
| 2,165,081 | 7/1939 | Wald | 2/247 |
| 2,249,966 | 7/1941 | Matthews | 2/2 |
| 2,629,094 | 2/1953 | Goldsmith | 2/2 |
| 2,774,073 | 12/1956 | Herbener | 450/115 X |
| 2,800,663 | 7/1957 | Falk | 2/247 |
| 2,930,046 | 3/1960 | Sagner | 2/247 |
| 3,295,530 | 1/1967 | Mayer et al. | 450/98 |
| 3,310,053 | 3/1967 | Greenwood | 2/2 X |
| 3,484,868 | 12/1969 | Davenport, Jr. | 2/2 |
| 3,515,142 | 6/1970 | Black | 450/117 X |
| 3,909,847 | 10/1975 | Holt et al. | 2/2 |
| 4,428,080 | 1/1984 | Takamatsu | 2/247 X |
| 4,455,686 | 6/1984 | Zide | 2/23 |
| 4,462,115 | 7/1984 | Carlson et al. | 2/403 X |
| 4,479,269 | 10/1984 | Balliet | 2/23 |
| 4,700,407 | 10/1987 | Mattila | 2/2 X |
| 5,105,473 | 4/1992 | Valtakari | 2/2 |

FOREIGN PATENT DOCUMENTS

| | | | |
|---|---|---|---|
| 2241773 | 3/1973 | Fed. Rep. of Germany | 450/115 |
| 2136675 | 9/1984 | United Kingdom | 2/2 |

*Primary Examiner*—Werner H. Schroeder
*Assistant Examiner*—Jeanette E. Chapman
*Attorney, Agent, or Firm*—Chase & Yakimo

[57] ABSTRACT

A compression sport pant is disclosed having pad pockets which are constructed in a manner to prevent early failure of the fabric of the garment to which the pockets are attached. The upper corners of the hip and tailbone pockets are anchored to the waistband, and the ends of the pocket seams are spaced sufficiently below the waistband to provide a region of the garment below the waistband that is free to stretch without exceeding its elastic limit in response to the pull on the waistband which will occur when a wearer puts on the pant.

10 Claims, 2 Drawing Sheets

FOOTBALL GRIDLE

This invention relates to improvements in compression sport pants that are provided with pad pockets and, in particular, to a special pocket construction that minimizes the stress on the compression fabric and extends the useful life of the pant.

In recent years the compression pant has become a widely used and accepted garment for active individuals and athletes engaged in sports and physical activity ranging from bicycling to football. The basic function of the compression pant (also known as compression shorts) is to serve as an athletic girdle and support for the muscles of the abdomen, lower back and thighs. This is accomplished through the use of a stretch fabric which is placed in tension as the pant is pulled into position on the wearer's body. Typically available in either thigh or knee-length models and in various colors, compression shorts are soothing and comfortable as well as fashionable and functional and are ideal for groin, quad, hamstring and stomach muscle compression.

In contact sports such as football the shorts are provided with internal pockets for receiving and holding protective pads. Hip, tailbone and thigh pockets may be provided on a fully-pocketed knee-length garment in order to provide maximum protection against impact.

Pad pockets are formed on the inside of the garment so that the tension of the fabric, when the pant is in place, will provide the desired muscular support and also hold the pads in position over the desired areas to be protected. Therefore, the material adjacent the edges of a pocket, particularly the upper portion of the pocket, is subjected to stress and elongation of the fibers of the fabric. High stress occurs in the usual course of putting on the pant when the wearer pulls the shorts or pant into position by grasping the waistband and pulling, as the pockets are pulled up by the material between the top of each pocket and the waistband. This causes severe stretching and ultimate failure of the garment, particularly above the hip pockets. It is not unusual for an active football player to wear out several pairs of shorts in a season due to tearing of the fabric at high stress points around the pockets.

SUMMARY OF THE INVENTION

It is, therefore, the primary object of the present invention to provide a compression sport pant having pockets formed therein in a manner to minimize stress on the fabric and extend the useful life of the pant.

As a corollary to the foregoing object, it is an important aim of this invention to minimize the stress on the fibers of the fabric adjacent the pockets by anchoring the hip and tailbone pockets to the waistband and spacing the seams, which secure the pockets, sufficiently below the waistband to provide a region of the garment between the waistband and such seams that is free to stretch in response to the pull on the waistband which will occur as a wearer puts on the pant.

Another important object of this invention is to provide a manner of attaching a pocket on a compression sport pant in which the top of the pocket is anchored to the waistband and the spacing of the seam below the waistband is sufficient to permit substantial elongation of the garment fabric in the region between the waistband and the ends of the seam so that the elastic limit of the fabric will not be exceeded when the pant is pulled into position on the wearer.

Still another important object is to provide a pocketed compression sport pant with an increased useful life, accomplished by extending the high pockets to the waistband where they are anchored to heavier material capable of absorbing pulling stresses without tearing, and locating the upper ends of the pocket stitching at least approximately one inch below the waistband to allow the fabric to stretch by elongation of its fibers instead of tearing.

Other objects will become apparent as the detailed description proceeds.

DETAILED DESCRIPTION

Figure 1:
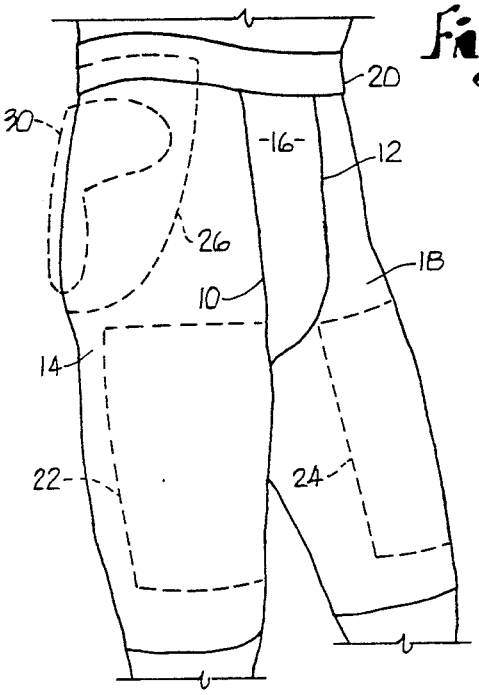
FIG. 1 is a right side and front perspective view illustrating the sport pant of the present invention on a wearer, the broken lines defining the edges of the inside pad pockets and also showing the location of a pad in the right hip pocket.
Figure 2:
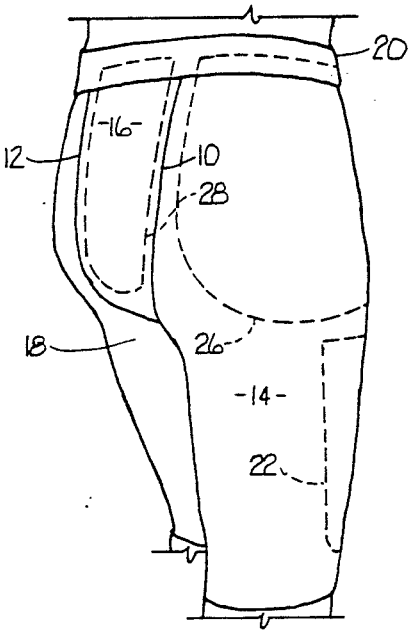
FIG. 2 is a perspective view of the rear and right side of the garment as worn, the broken lines defining the edges of the pockets as in FIG. 1.

Referring initially to FIGS. 1 and 2, the compression sport pant of the present invention is shown in place on the body of a wearer. The garment has three sections stitched together at main seams 10 and 12, a right pelvis and leg section 14, a crotch section 16, and a left pelvis and leg section 18. The main seams 10 and 12 extend from the front of a waistband 20 down under the crotch and up to the back of the waistband 20 as may be appreciated from a comparison of FIGS. 1 and 2. The waistband 20 is securely fastened by multiple stitching 21 (FIGS. 4–6) to the upper edge of the body sections 14, 16 and 18. (The pocket seams to be described below, though visible, are not shown in FIGS. 1 and 2 for simplicity and to avoid confusion in the illustrations, it being understood that the pocket seams extend along the side and bottom portions of the edge of each pocket shown in broken lines.)

The pant illustrated is a knee-length football girdle provided with five pad pockets, four of which are at least partially visible in the drawings in full or phantom lines. The edge or outline of the right thigh pocket is shown at 22 in FIGS. 1 and 2, the edge of the right thigh pocket is shown at 24 in FIG. 1, the edge of the right hip pocket is shown at 26 in FIGS. 1 and 2, and the edge or outline 28 of the tailbone pocket is seen in its entirety in FIG. 2. The left hip pocket (not shown) is identical to the right hip pocket and is also formed on the inside of the garment. For purposes of illustration, a hip pad 30 is shown in phantom lines in FIG. 1 inserted into and held within the right hip pocket of the pant.

The body sections 14, 16 and 18 are made from a highly resilient fabric, preferably a blend of 75 percent nylon and 25 percent Lycra® (DuPont registered trademark) having a rating of approximately 280 denier. This provides a fabric having four-way stretchability and the capability of elongation of its fibers to over twice their normal length without exceeding the elastic limit of the fabric. The utilization of a four-way stretch fabric provides the pant with the compression characteristics necessary for effective compression support of the underlying muscles of the wearer.

Figure 3:
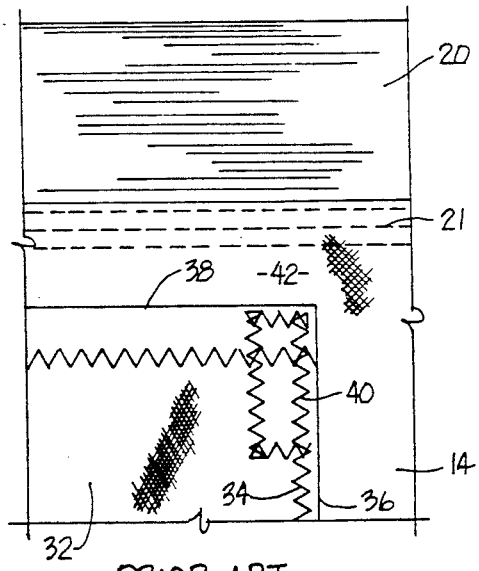
PRIOR ART Fig. 3
FIG. 3 is an enlarged, fragmentary, detail view of the interior of a compression pant garment of the prior art, showing the manner of attachment of a pad pocket to the fabric adjacent the waistband.

Referring to FIG. 3, a method of attachment of a pad pocket heretofore employed is illustrated. A pocket panel 32 is sewed at 34 to the right body section 14 (for example) on the inside of the garment by a line of stitching seen partially at 34 and which extends along the side and bottom edge portions 36 of the panel 32, leaving the pocket open at the top hem 38. The upper corners of the pocket are anchored directly to the fabric of the body section 14 as shown by the corner tack stitching 40. As this stitching 40 is closely spaced from the stitching 21 that joins the waistband 20 to the upper edge of section 14, high stress occurs in the narrow strip 42 of the fabric between the waistband 20 and the stitching 40 when the wearer grasps the waistband 20 and puts on the pant. Ultimately, the fabric in strip 42 tears due to repeated stretching beyond its elastic limit and the garment is discarded.

Figure 4:
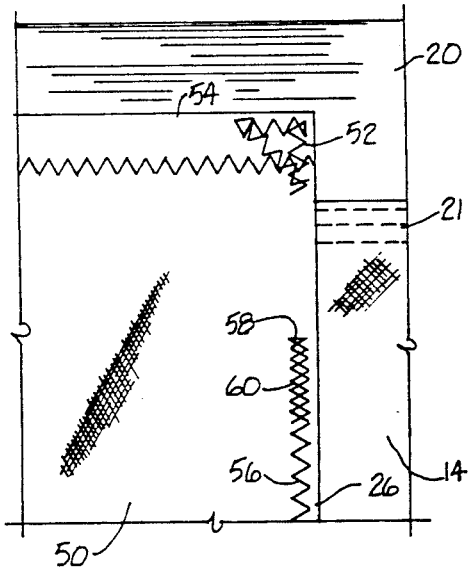
FIG. 4 is a detail similar to FIG. 3 but showing the manner of attachment of the present invention.

In contrast, the manner of attachment of the present invention is illustrated in FIG. 4. A pocket panel 50 is composed of the same nylon/Lycra fabric as the body section 14 and forms the right hip pocket of the illustrated garment. An upper corner of the panel 50 is anchored by stitching 52 directly to the waistband 20, the latter being composed of a relatively heavy material (such as Lycra) having two-way longitudinal stretchability. The waistband 20 is, therefore, substantially inelastic in the transverse or vertical direction. The opposite upper corner of the panel 50 (not shown) is likewise anchored directly to the waistband 20. A hem 54 is provided at the top of panel 50 and is not sewed to the waistband, thereby presenting an opening into the pocket at the top into which a pad (not shown) would typically be inserted.

The edge 26 is secured to the body section 14 by a line of attachment provided by zigzag stitching 56 extending continuously from an upper end 58 downwardly along edge 26 and the bottom of the pocket to a corresponding upper end on the opposite side of the pocket (not shown). The zigzag stitching 56 is provided with a back tack 60 at the end 58, and an identical back tack (not shown) is provided at the opposite end of the stitching 56. By this arrangement, the fabric of the body section 14 between the waistband 20 and the end 58 of the stitching 56 is allowed to stretch (elongate) below the waistband when the pant is pulled into position on the wearer, and a substantial portion of the stress is absorbed by the heavy fabric of the waistband 20 since the pocket is anchored directly to the waistband at 52. It is important to note that the distance between the bottom of the waistband 20 and the end 58 of the line of stitching 56 is at least approximately 1 inch to provide for free stretching of the fabric.

Figure 5:
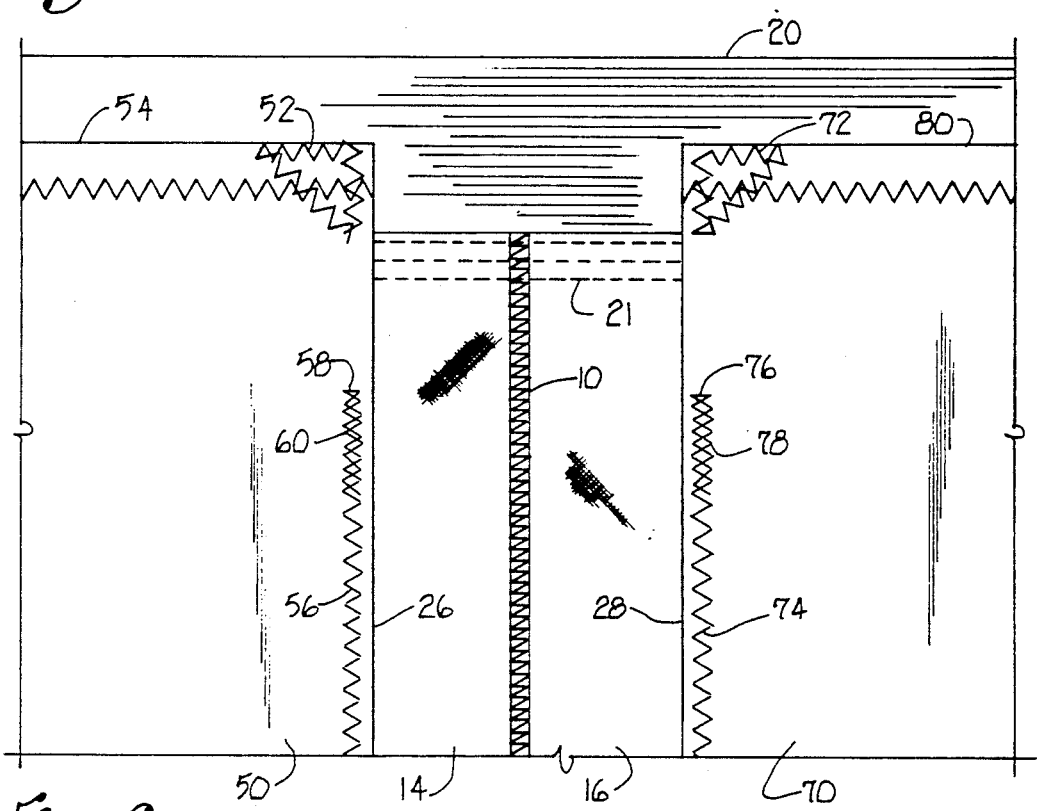
FIG. 5 is a fragmentary view of the inside of the garment of the present invention looking at a rear seam and portions of the adjacent right hip and tailbone pockets, the material being shown in an unstretched condition prior to putting on the pant.
Figure 6:
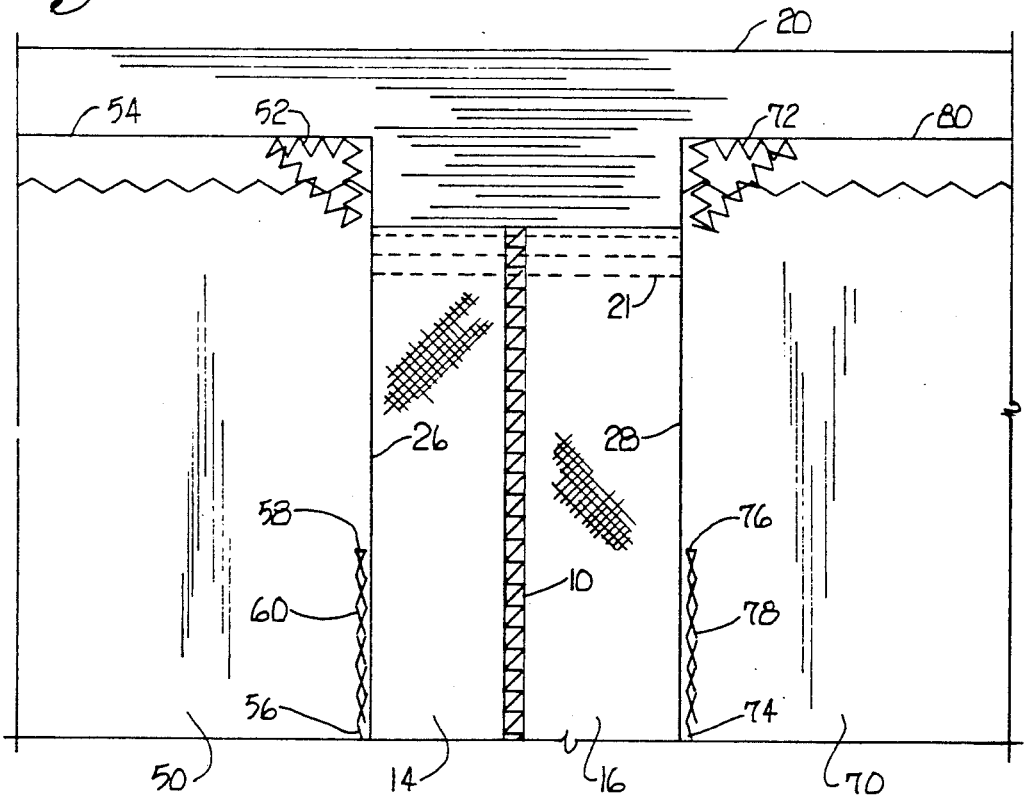
FIG. 6 is a view similar to FIG. 5 but showing the stretched condition of the fabric when the pant is being pulled into position on the wearer's body.

This action may also be visualized by a comparison of FIGS. 5 and 6. In addition to the pocket panel 50, a portion of an adjacent pocket panel 70 forming the tailbone pocket is shown. The upper left corner of the panel 70 is anchored by stitching 72 to the waistband 20, and a line of zigzag stitching 74 begins below the waistband at 76 and extends along the edge 28 of the pocket to the opposite end of the stitching (not shown). As described previously, a back tack 78 is provided at the end 76. The opening of the tailbone pocket is at the free upper edge portion 80 of the pocket panel 70. FIG. 5 shows the material in its relaxed condition prior to putting o the garment.

FIG. 6 illustrates the stretching of the fabric as the garment is pulled into place by the wearer. The primary stress is applied at the anchors 52 and 72 so that it is absorbed by the heavier fabric of the waistband 20. The fibers of the body sections 14 and 16 (and panels 50 and 70) undergo substantial elongation in the free region between the waistband 20 and the upper ends 58 and 76 of the pocket seams 56 and 74 without exceeding the elastic limit of the material. It should be appreciated that the zigzag stitching used both in the pocket seams and the main seam 10 also permits the material to stretch without damage.

FIGS. 5 and 6 also clearly illustrate that the anchor 52 and 72 are vertically aligned with the respective ends 58 and 76 of the lines of stitching 56 and 74. Furthermore, it is to be understood that the other pocket anchors not shown have the same aligned relationship with the ends of the pocket stitching therebeneath. Only the shapes of the pockets vary to conform to the underlying portion of the body (hip or tailbone); the attachment of each of the hip and tailbone pocket panels to the body sections of the garment and the waistband is identical. Therefore, during the period of high fabric stress when the garment is being pulled into position on the wearer, all of the anchors for the upper pockets focus the primary stress on the waistband material and reduce the stress applied to the ends of the pocket seams directly beneath the anchors. Accordingly, the useful life of the garment is materially increased as premature failure of the fabric at the top of the upper pockets is prevented.

Having thus described the invention what is claimed as new and desired to be secured by Letters Patent is as follows:

1. A compression sport pant comprising: a garment of resilient fabric shaped to compliment the pelvic region and legs of a wearer and presenting an upper edge, a waistband joined to said upper edge of the garment, a pocket panel of resilient fabric, first attachment means anchoring said panel to said waistband, second attachment means below said waistband providing a line of attachment of said panel to said garment having an end spaced a predetermined distance from said waistband to define a region of the garment between the waistband and said end which is free to stretch in response to a pull on the waistband, and said line of attachment extending along an edge portion of the panel to provide a pocket on the garment, whereby the pocket is anchored to the waistband and the garment is allowed to stretch in said region to minimize stress on the fabric and extend the useful life of the pant.

2. The sport pant as claimed in claim 1, wherein said waistband is of heavier material than said fabric to provide a support to which said pocket is anchored.

3. The sport pant as claimed in claim 1, wherein said waistband is substantially inelastic transversely thereof to provide a support to which said pocket is anchored.

4. The sport pant as claimed in claim 1, wherein said fabric of the garment and pocket panel is characterized by the property of four-way stretchability.

5. The sport pant as claimed in claim 1, wherein said second attachment means comprises zigzag stitching defining said line of attachment.

6. The sport pant as claimed in claim 5, wherein said stitching is provided with a back tack at said end of the line of attachment.

7. The sport pant as claimed in claim 1, wherein said predetermined distance is at least approximately one inch.

8. A compression sport pant comprising:

a garment of resilient fabric shaped to compliment the pelvic region and legs of a wearer and presenting an upper edge, a waistband joined to said upper edge of the garment, a pocket panel of resilient fabric, first attachment means anchoring said panel to said waistband, second attachment means below said waistband providing a line of attachment of said panel to said garment having opposite ends spaced from said waistband to define a region of the garment between the waistband and said ends which is free to stretch in response to a pull on the waistband, and said line of attachment extending from end to end along an edge portion of the panel to provide a pocket on the garment presenting an opening thereinto adjacent the waistband, whereby the pocket is anchored to the waistband and the garment is allowed to stretch in said region to minimize stress on the fabric and extend the useful life of the pant.

9. The sport pant as claimed in claim 8, wherein said ends of the line of attachment are spaced below the waistband a predetermined distance sufficient to permit substantial elongation of the garment fabric in response to a pull on the waistband.

10. The sport pant as claimed in claim 8, wherein said first attachment means includes a pair of fastening means spaced along said waistband and located in substantial alignment with the respective ends of said line of attachment.

* * * * *

UNITED STATES PATENT AND TRADEMARK OFFICE

CERTIFICATE OF CORRECTION

PATENT NO. : 5,161,257

DATED : November 10, 1992

INVENTOR(S) : Stephen C. Arensdorf; Lawrence T. Stromgren

It is certified that error appears in the above—identified patent and that said Letters Patent is hereby corrected as shown below:

On the Title page, item[54]

The title of the invention should be corrected from [FOOTBALL GRIDLE] to --FOOTBALL GIRDLE--.

Signed and Sealed this

Nineteenth Day of October, 1993

*Attest:*

*Attesting Officer*

BRUCE LEHMAN

*Commissioner of Patents and Trademarks*